US007013539B2

(12) United States Patent
Fildan et al.

(10) Patent No.: US 7,013,539 B2
(45) Date of Patent: Mar. 21, 2006

(54) WELD BUTTON FOR GARMENTS

(75) Inventors: Gerhard Fildan, Vienna (AT); Karl Wanzenböck, Leobersdorf (AT)

(73) Assignee: Fildan Accessories Corporation, Humble, TX (US)

( * ) Notice: Subject to any disclaimer, the term of this patent is extended or adjusted under 35 U.S.C. 154(b) by 8 days.

(21) Appl. No.: 10/846,159

(22) Filed: May 13, 2004

(65) Prior Publication Data

US 2005/0251971 A1 Nov. 17, 2005

(51) Int. Cl.
*A44B 7/00* (2006.01)

(52) U.S. Cl. ..... 24/693; 24/114.6; 24/662; 24/692; 2/265

(58) Field of Classification Search ..... 2/265; 24/697.2, 693, 114.6, 692, 691, 690, 662, 24/689, 688
See application file for complete search history.

(56) References Cited

U.S. PATENT DOCUMENTS

| | | | | |
|---|---|---|---|---|
| 3,159,890 A * | 12/1964 | Jensen | 24/692 |
| 3,195,201 A * | 7/1965 | Ash, II | 24/689 |
| 3,355,780 A * | 12/1967 | Daddona, Jr. | 24/689 |
| 4,253,226 A * | 3/1981 | Takeda | 24/691 |
| 6,298,527 B1 * | 10/2001 | Fildan et al. | 24/692 |
| 6,393,678 B1 * | 5/2002 | Fildan et al. | 24/662 |
| 6,442,808 B1 * | 9/2002 | Fildan et al. | 24/693 |

* cited by examiner

*Primary Examiner*—Robert J. Sandy
(74) *Attorney, Agent, or Firm*—Herbert Dubno

(57) ABSTRACT

A weld button for garments, i.e. a button, snap or interlocking fastener has fastener halves on two parts of a garment which are releasably joined and in which each of the fastener halves is affixed to the garment by welding two parts of the respective fastening half together.

18 Claims, 5 Drawing Sheets

WELD BUTTON FOR GARMENTS

FIELD OF THE INVENTION

Our present invention relates to a weld button for garments, i.e. a button, snap or interlocking fastener having fastener halves on two parts of a garment which are releasably joined and in which each of the fastener halves is affixed to the garment by welding two parts of the respective fastening half together.

BACKGROUND OF THE INVENTION

It is known to weld two parts of a fastener together through a fabric support for the resulting fastener. Generally speaking, such fasteners have an array of projections on one part which are intended to pierce through the fabric and to weld, especially ultrasonically, to the other part.

The projections are generally disposed in a circular array, i.e. lie along an imaginary circle centered at the center of the button or fastener.

Experience with such fasteners has shown that improvement is required in attachment of the two parts of the fastener together.

OBJECTS OF THE INVENTION

It is, therefore, the principal object of the present invention to provide an improved weld button or welded fastener in which the two parts of a fastener which are to be secured together by welding are joined more reliably and securely than has hitherto been the case.

Another object of this invention is to provide a weld button or fastener of the type described at the outset and in which the drawbacks of earlier fasteners are avoided.

SUMMARY OF THE INVENTION

We have now found that the disadvantages described previously can be overcome by providing an additional pin or projection which can be disposed at the center of the circular array of weld pins previously described on one of the fastener halves, can pierce through the fabric and can project into the other fastener part on the opposite side of the fabric support and can be welded to that other part. Preferably that central pin is headed after passing through the hole in the other part and that head is welded to the aforementioned other part.

More particularly, a weld button for a garment according to the invention can comprise:

a first fastener consisting of an inner member and an outer member of weldable synthetic resin material, one of the members having a plurality of spikes disposed in an annular array and projecting toward the other of the members and adapted to pierce a fabric and be welded to the other member, the inner member having a hole within the array and the outer member having a central pin adapted to pierce the fabric and fit through the hole to form a head on an inner side of the inner member, the head being welded to the inner member; and a second fastener consisting of an inner member and an outer member of weldable synthetic resin material, one of the members of the second fastener having a plurality of spikes disposed in an annular array and projecting toward the other of the members of the second fastener and adapted to pierce a fabric and be welded to the other member of the second fastener, the inner member of the second fastener having a hole within the array and the outer member of the second fastener having a central pin adapted to pierce the fabric and fit through the hole in the inner member of the second fastener to form a head on an inner side of the inner member of the second fastener welded to the inner member of the second fastener, one of the inner members having on a respective the inner side a male formation and the other of the inner members having on the respective the inner side a female formation releasably engageable with the male formation upon mounting of the first and second fasteners on opposite parts of a garment.

The male formation can be an annular ridge surrounding the respective hole while the female formation can be an inwardly tapering annular wall surrounding the respective hole. Each of the outer members can have a smooth outer surface and the spikes can be formed on the outer member of at least one of those fasteners.

In an alternative configuration, the spikes are formed on the inner member. Each of the spikes can be provided with a point adapted to pierce the fabric and a shank having a lesser taper than the point. Each head can have a mushroom-shaped cross section.

A garment can have opposite parts connected by the weld button in accordance with another aspect of the invention.

BRIEF DESCRIPTION OF THE DRAWING

The above and other objects, features, and advantages will become more readily apparent from the following description, reference being made to the accompanying drawing in which.

SPECIFIC DESCRIPTION

Figure 9:
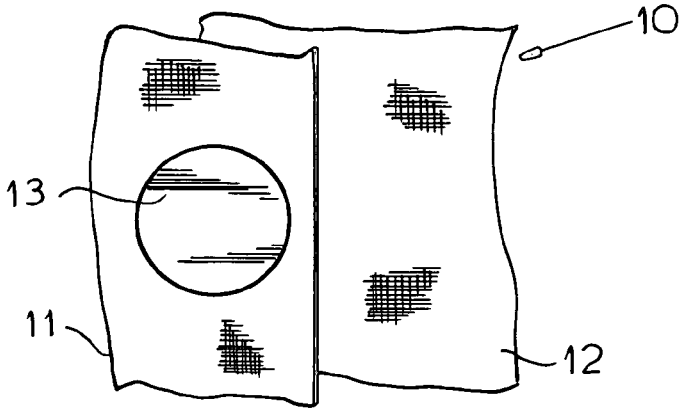
FIG. 9 is an elevational view of a portion of a garment provided with the weld button of the invention.

A garment 10 (FIG. 9) can have two fabric parts 11 and 12 which are held together by a weld button 13 having two fasteners, each connected to a respective one of the parts 11 and 12 and adapted to be releasably joined together.

Figure 1:
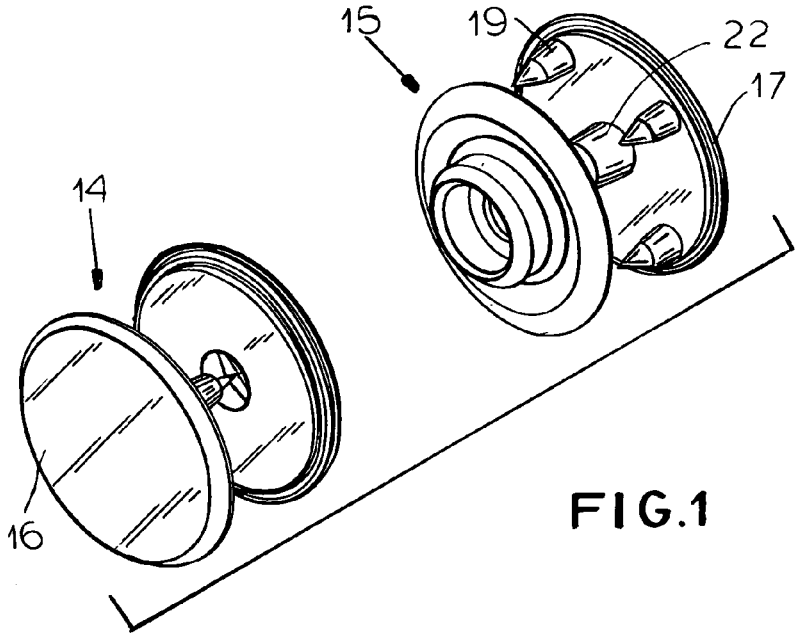
FIG. 1 is an exploded perspective view of a weld button according to the invention.
Figure 2:
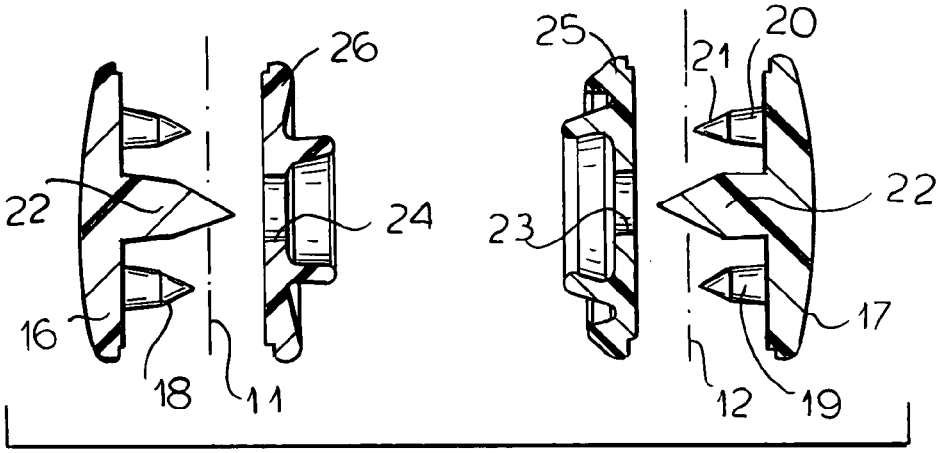
FIG. 2 is an exploded cross sectional view thereof.

As can be seen from FIGS. 1 and 2, these can include a first fastener 14 and a second fastener 15, each of which can have an outer member 16 or 17 having a plurality of spikes 18 or 19 disposed in an annular array, here a circular array around the center of the circular member. Each of these spikes 18 or 19 comprises a shank 20 and a pointed tip 21, the point being more sharply tapered than the shank 20. In addition, each of the outer members 16 or 17 has a central spike or pin 22 which is of larger diameter than the spikes 18 or 19, adapted to be received in a hole 23, 24 in an inner member 25, 26 of the respective fastener 15 or 14.

Figure 3:
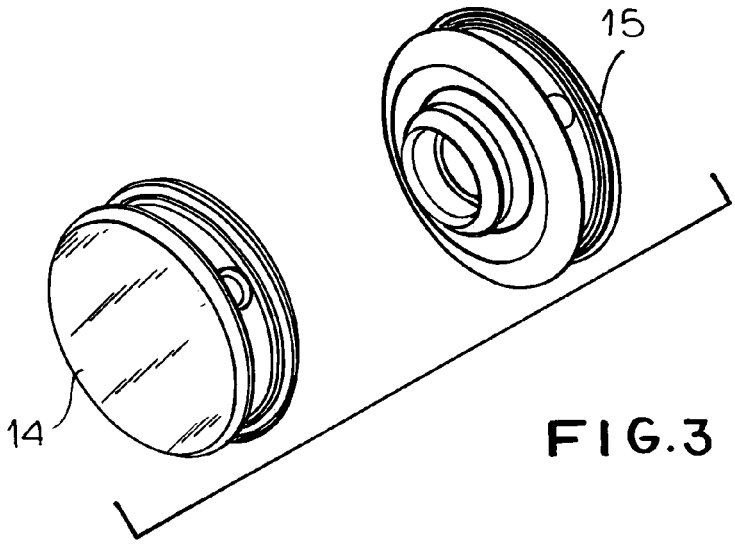
FIG. 3 is a view similar to FIG. 1 in which the fastener halves are shown welded together.
Figure 4:
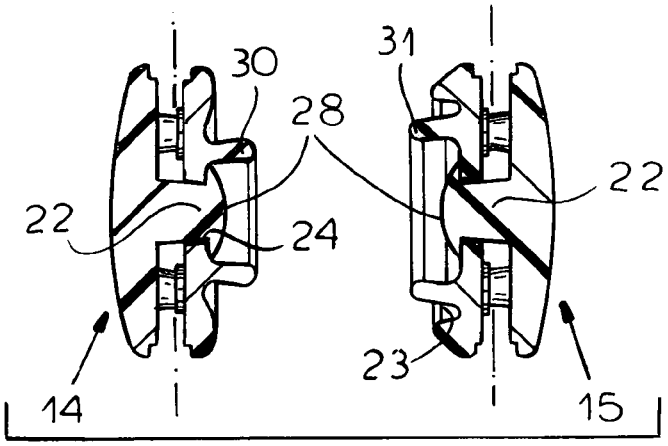
FIG. 4 is a cross sectional view corresponding to FIG. 3.

As has been shown diagrammatically in FIG. 2, the fabric 11 or 12 is interposed between the outer members 16 or 17 and the respective inner member 24 or 23. The fabric can be pierced by the spikes 18 or 19. When the fasteners are pressed together (FIGS. 3 and 4), the spikes pass through the fabric and are welded against the inner members 24 and 25 and the pin 22 is simultaneously forced through the hole 23 or 24, given a mushroom head 28 and welded to the interior of the respective inner member 23, 24.

Figure 5:
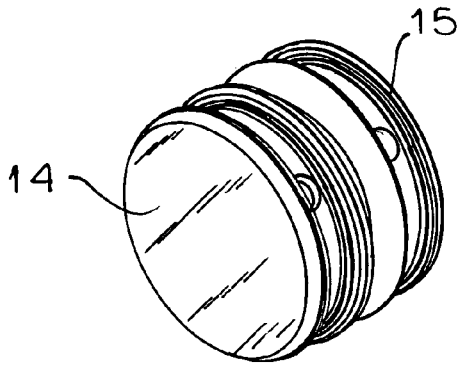
FIG. 5 is a perspective view showing the two parts of the fastener joined together.
Figure 6:
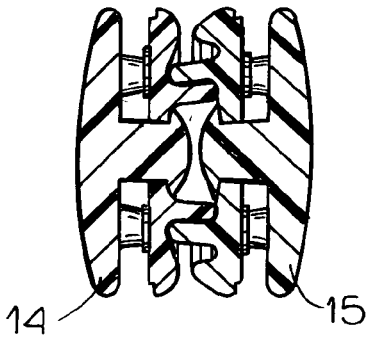
FIG. 6 is a cross sectional view corresponding to FIG. 5.

Each of the fasteners which then results has a formation enabling it to releasably engage the other fastener. In the embodiment illustrated in FIGS. 1–6, fastener 14 has a male formation in the form of an annular ridge 30 surrounding the respective hole and the pin 22. The male formation 30 is engageable with a snap fit in a female formation 31 of the other fastener 15, the female formation surrounding the hole of its member 23 and pin 22. In FIGS. 5 and 6 the snap button has its male and female formation releasably joined together.

Figure 7:
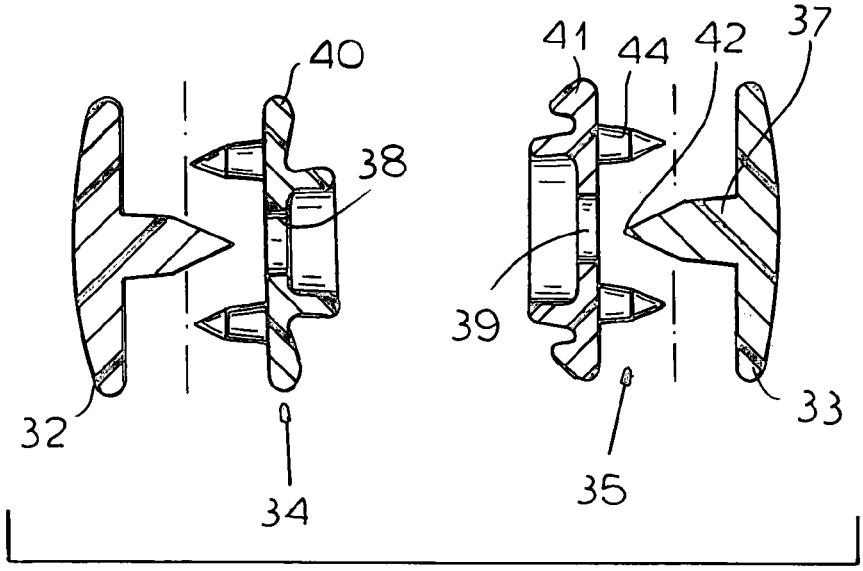
FIG. 7 is a view similar to FIG. 2 but of an alternative embodiment.

An alternative arrangement has been shown in FIG. 7 wherein the outer member 32, 33 of each fastener part 34, 35 is provided with the central pin 36, 37 engageable in a hole 38, 39 of the respective inner member 40, 41. Once received in the hole, the point 42 of the central pin 36, 37 is mushroomed to form the head analogous to the head 28 which has been described.

In the embodiment of FIG. 7, however, the spikes which are represented at 43 and 44 and lie in a circular array are formed on the respective inner member 40, 41 rather than upon the outer member as shown in FIG. 2 and upon piercing the fabric, are welded to the outer member around the respective pin 36, 37.

Since the spikes of the one member are welded to the other and the mushroom head of the central pin of the other member can be welded to the member provided by the spikes, the two members of each fastener are permanently joined together and will not release or separate.

Figure 8:
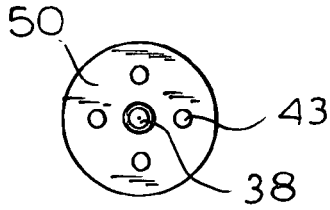
FIG. 8 is an elevational view showing the circular array of spikes.

In FIG. 8 the spikes 43 have been shown to surround the hole 38 and to lie along an imaginary circle 50 in forming the circular array.

Figure 10:
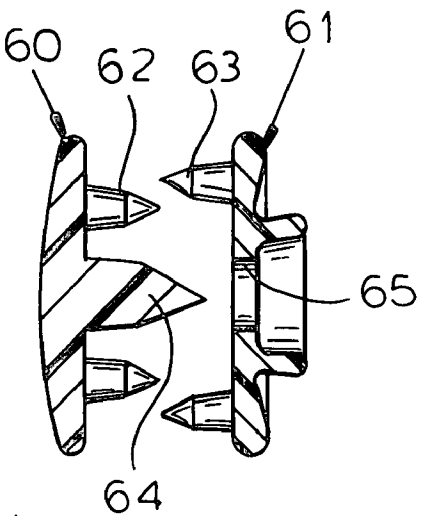
FIG. 10 is a view similar to a part of FIG. 2 but showing another arrangement of the spikes.

FIG. 10 shows the male fastener half, prior to assembly, of an embodiment in which both the outer member 60 and the inner member 61 have spikes 62 and 63, so positioned that the spikes of one member are located between the spikes of the other member along a common imaginary circle when the members are engaged and the pin 64 fitted into the hole 65 prior to welding.

Figure 11:
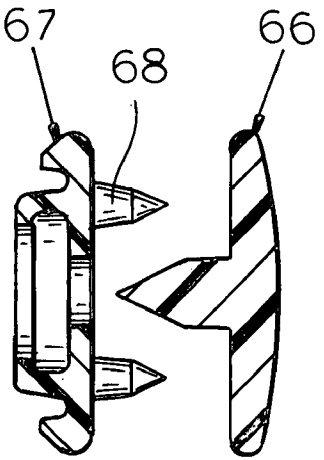
FIG. 11 is another cross sectional view showing another spike arrangement.

In FIG. 11, the outer member 66 and the inner member 67 of a female fastener half are shown but only the inner member 67 has spikes 68 in this embodiment.

Figure 13:
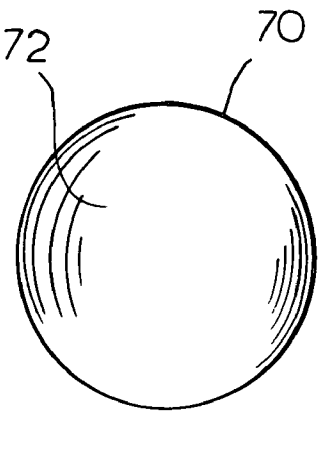
FIG. 13 is a view corresponding to FIG. 12 showing the outer member with a smooth or shiny finish.
Figure 12:
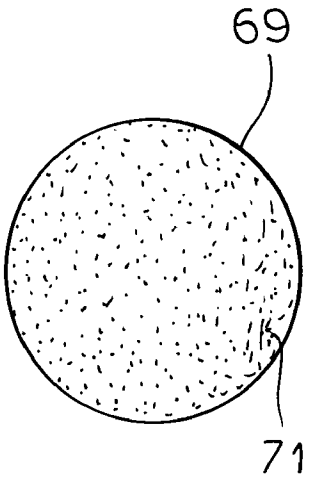
FIG. 12 is an elevational view of one of the outer members having a matte finish.

FIGS. 12 and 13 show outer members 69 and 70 of male or female fastener halves with surfaces of different texture. The surface 71 of the embodiment of FIG. 12 has a matte finish while the surface 72 of the embodiment of FIG. 73 has a smooth, polished or shiny finish.

Figure 14:
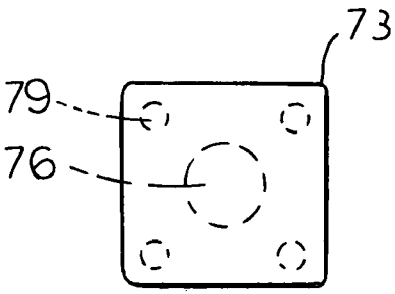
FIG. 14 is an elevational view of an outer member of a different configuration from those of the embodiments of FIGS. 1 through 13.
Figure 15:
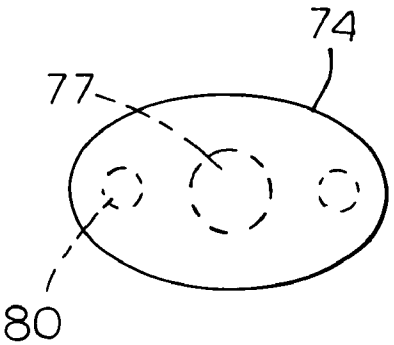
FIG. 15 is a view similar to FIG. 14 showing still another configuration.
Figure 16:
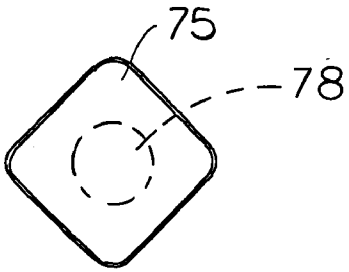
FIG. 16 is a view similar to FIG. 15 of still another embodiment.

FIGS. 14, 15 and 16 show configurations of outer members 73, 74 and 75 which differ from one another, the outer members having central pins 76, 77 and 78 and may in addition, have spikes 79 and 80. In the embodiment of FIG. 14, the configuration of the outer member 73 is a square or rectangular configuration whereas in FIG. 15, the outer member 76 has an oral configuration and the configuration of the outer member 75 is that of a diamond.

Figure 17:
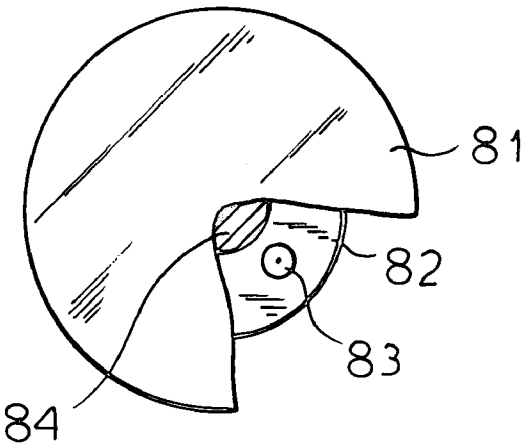
FIG. 17 is an elevational view, partly broken away, of an embodiment in which the outer member is significantly larger than the inner member of a fastener half.

From FIG. 17, it will be apparent that the outer member 81 can be substantially larger than the inner member 82 which, in this embodiment, carries the spikes 83 while the central pin 84 is provided on the outer member 81. In the embodiments of FIGS. 1 to 11, the inner and outer members have the same diameter.

We claim:

1. A weld button for garments comprising:

a first fastener consisting of an inner member and an outer member of weldable synthetic resin material, at least one of said members having a plurality of spikes disposed in an annular array and projecting toward the other of said members and adapted to pierce a fabric and be welded to said other member, said inner member having a hole within said array and said outer member having a central pin adapted to pierce said fabric and fit through said hole to form a head on an inner side of said inner member, said head being welded to said inner member; and a second fastener consisting of an inner member and an outer member of weldable synthetic resin material, at least one of said members of said second fastener having a plurality of spikes disposed in an annular array and projecting toward the other of said members of said second fastener and adapted to pierce a fabric and be welded to said other member of said second fastener, said inner member of said second fastener having a hole within said array and said outer member of said second fastener having a central pin adapted to pierce said fabric and fit through said hole in said inner member of said second fastener to form a head on an inner side of said inner member of said second fastener welded to said inner member of said second fastener, one of said inner members having on a respective said inner side a male formation and the other of said inner members having on the respective said inner side a female formation releasably engageable with the male formation upon mounting of said first and second fasteners on opposite parts of a garment.

2. The weld button defined in claim 1 wherein said male formation is an annular ridge surrounding the respective hole and said female formation is an inwardly tapering annular wall surrounding the respective hole.

3. The weld button defined in claim 2 wherein each of said outer members has a smooth outer surface.

4. The weld button defined in claim 3 wherein said spikes are formed on said outer member of at least one of said fasteners.

5. The weld button defined in claim 3 wherein said spikes are formed on the inner member of at least one of said fasteners.

6. The weld button defined in claim 3 wherein said outer members have smooth outer surfaces.

7. The weld button defined in claim 3 wherein said members are all circular and of generally the same diameter.

8. The weld button defined in claim 3 wherein each of said spikes is provided with a point and a shank connected to the respective point and with a shallower taper than the point.

9. The weld button defined in claim 3 wherein each head has a mushroom-shaped cross section.

10. A garment having opposite parts connectable by a weld button, said weld button comprising:

a first fastener on one of said parts consisting of an inner member and an outer member of weldable synthetic resin material, at least one of said members having a plurality of spikes disposed in an annular array and projecting toward the other of said members and adapted to pierce a fabric of said one of said parts and be welded to said other member, said inner member having a hole within said array and said outer member having a central pin adapted to pierce said fabric and fit through said hole to form a head on an inner side of said inner member, said head being welded to said inner member; and a second fastener on the other of said parts consisting of an inner member and an outer member of weldable synthetic resin material, at least one of said members of said second fastener having a plurality of spikes disposed in an annular array and projecting toward the other of said members of said second fastener and adapted to pierce a fabric of the other part and be welded to said other member of said second fastener, said inner member of said second fastener having a hole within said array and said outer member of said second fastener having a central pin adapted to pierce said fabric and fit through said hole in said inner member of said second fastener to form a head on an inner side of said inner member of said second fastener welded to said inner member of said second fastener, one of said inner members having on a respective said inner side a male formation and the other of said inner members having on the respective said inner side a female formation releasably engageable with the male formation upon mounting of said first and second fasteners on said parts of the garment.

11. The garment defined in claim 10 wherein said male formation is an annular ridge surrounding the respective hole and said female formation is an inwardly tapering annular wall surrounding the respective hole.

12. The garment defined in claim 11 wherein each of said outer members has a smooth outer surface.

13. The garment defined in claim 12 wherein said spikes are formed on said outer member of at least one of said fasteners.

14. The garment defined in claim 12 wherein said spikes are formed on the inner member of at least one of said fasteners.

15. The garment defined in claim 12 wherein said outer members have smooth or matte outer surfaces.

16. The garment defined in claim 12 wherein said members are all circular and of generally the same diameter.

17. The garment defined in claim 12 wherein each of said spikes is provided with a point and a shank connected to the respective point and with a shallower taper than the point.

18. The garment defined in claim 12 wherein each head has a mushroom-shaped cross section.

* * * * *